US009291383B2

(12) United States Patent
Besore

(10) Patent No.: US 9,291,383 B2
(45) Date of Patent: Mar. 22, 2016

(54) DEMAND RESPONSE MULLION SWEAT PROTECTION

(75) Inventor: John K. Besore, Prospect, KY (US)

(73) Assignees: Clemson University, Clemson, SC (US); Hokkaido University, Sapporo (JP)

( * ) Notice: Subject to any disclaimer, the term of this patent is extended or adjusted under 35 U.S.C. 154(b) by 1220 days.

(21) Appl. No.: 12/859,411

(22) Filed: Aug. 19, 2010

(65) Prior Publication Data

US 2012/0042666 A1 Feb. 23, 2012

(51) Int. Cl.
*F25D 21/04* (2006.01)
*F25B 21/02* (2006.01)

(52) U.S. Cl.
CPC ..... *F25D 21/04* (2013.01); *F25B 21/02* (2013.01); *F25B 2700/02* (2013.01)

(58) Field of Classification Search
CPC .. F25B 2700/02; F25B 2700/11; F25D 12/02; F25D 12/04; F25D 12/08; F25D 12/14
USPC ..... 62/150, 176.6, 248; 165/230, 231, 233; 236/44 C
See application file for complete search history.

(56) References Cited

U.S. PATENT DOCUMENTS 3,859,502 A * 1/1975 Heaney ..... 219/218
3,939,666 A * 2/1976 Bashark ..... 62/150
4,127,765 A * 11/1978 Heaney ..... 219/218
4,142,092 A * 2/1979 Abrams ..... 219/218
4,260,876 A * 4/1981 Hochheiser ..... F25D 21/04 219/203
4,332,142 A * 6/1982 Prada ..... F25D 21/04 62/152
4,474,017 A * 10/1984 Prada ..... F25D 21/04 29/437
4,822,117 A 4/1989 Boston, Jr.
4,862,701 A * 9/1989 Small ..... F25D 21/02 200/61.04
4,881,315 A * 11/1989 Powell ..... F16B 5/125 24/457
4,941,289 A * 7/1990 Rolek ..... A47F 3/043 49/478.1
5,255,531 A * 10/1993 Williams ..... F25D 23/028 312/406
5,277,035 A * 1/1994 Fristoe ..... F25D 21/04 62/277
5,598,349 A * 1/1997 Elliason et al. ..... 700/295
5,638,694 A 6/1997 Banicevic
5,778,689 A * 7/1998 Beatenbough ..... 62/150
(Continued)

FOREIGN PATENT DOCUMENTS

CN 201377956 Y 1/2010
CN 101684980 A 3/2010
CN 201478706 U 5/2010

OTHER PUBLICATIONS

Unofficial translation of Chinese Office Action issued from CN Patent No. 201110280116.1 dated Oct. 14, 2014.
(Continued)

*Primary Examiner* — Jonathan Bradford
(74) *Attorney, Agent, or Firm* — Dority & Manning, P.A.

(57) ABSTRACT

An appliance such as a refrigerator receives a demand response signal indicating a peak demand period and operates the refrigerator in an energy savings mode by disabling an anti-sweat heater. A sensor on an external surface of the refrigerator enables the anti-sweat heater during the peak demand period if moisture is detected by the sensor. A pre-selected location can be defined where incipient moisture would form such as reducing the amount of insulation in this location. By forming a depression in the location and using an impedance-type sensor, moisture can be easily detected. The sensor signal is sent to the controller which then activates the anti-sweat heater to remove the moisture.

11 Claims, 4 Drawing Sheets

(56) References Cited

U.S. PATENT DOCUMENTS

| | | | | |
|---|---|---|---|---|
| 5,899,078 | A * | 5/1999 | Mager | 62/80 |
| 6,138,461 | A * | 10/2000 | Park et al. | 62/126 |
| 6,324,853 | B1 * | 12/2001 | Kelly et al. | 62/80 |
| 6,739,146 | B1 * | 5/2004 | Davis et al. | 62/155 |
| 7,010,363 | B2 | 3/2006 | Donnelly et al. | |
| 7,240,501 | B2 * | 7/2007 | Bunch et al. | 62/150 |
| 7,340,907 | B2 * | 3/2008 | Vogh, III | 62/150 |
| 8,250,873 | B2 * | 8/2012 | Yoon et al. | 62/150 |
| 8,256,236 | B2 * | 9/2012 | Lofy | 62/150 |
| 8,434,317 | B2 * | 5/2013 | Besore | 62/150 |
| 2003/0177776 | A1 * | 9/2003 | Ghent | D06F 39/005 62/231 |
| 2005/0120728 | A1 * | 6/2005 | Carter | 62/151 |
| 2005/0217286 | A1 * | 10/2005 | Jeong | F25D 21/08 62/151 |
| 2005/0229614 | A1 * | 10/2005 | Ansted | 62/150 |
| 2005/0268627 | A1 * | 12/2005 | Vogh, III | 62/150 |
| 2006/0026975 | A1 | 2/2006 | Bunch et al. | |
| 2006/0095164 | A1 * | 5/2006 | Donnelly et al. | 700/295 |
| 2006/0196206 | A1 * | 9/2006 | Murray et al. | 62/248 |
| 2007/0056300 | A1 * | 3/2007 | Crane | F25B 49/025 62/175 |
| 2007/0193294 | A1 * | 8/2007 | Murray et al. | 62/248 |
| 2008/0115514 | A1 * | 5/2008 | Steimel | 62/176.6 |
| 2009/0001182 | A1 * | 1/2009 | Siddaramanna et al. | 236/46 R |
| 2009/0090114 | A1 * | 4/2009 | Choo | 62/80 |
| 2010/0083672 | A1 * | 4/2010 | Yoon et al. | 62/85 |
| 2010/0101254 | A1 * | 4/2010 | Besore et al. | 62/264 |
| 2011/0094292 | A1 * | 4/2011 | Liu | 73/29.02 |
| 2011/0098869 | A1 * | 4/2011 | Seo et al. | 700/296 |

OTHER PUBLICATIONS

Humirel Advanced Information, "Analog Voltage Relative Humidity and Temperature Module," HTG3515CH Compliant with RoHS regulations, *Measurement Specialties*, Aug. 2006.

* cited by examiner

DEMAND RESPONSE MULLION SWEAT PROTECTION

BACKGROUND OF THE DISCLOSURE

This disclosure relates to a demand supply response associated with an appliance, and particularly a refrigerator, freezer, wine chiller, etc. where operation of the appliance may be altered in response to a high demand for energy and peak pricing. Selected aspects may find application in related applications.

It is well known that refrigerators have two or more compartments for storing food items, that is, at least one freezer compartment and at least one fresh food compartment. The locations of the separate compartments may vary, for example, from a bottom mount refrigerator where the freezer is located on the bottom and the fresh food compartment is on top or vice versa, to a side-by-side arrangement where one side is the freezer compartment and the other side is the fresh food compartment. These compartments are divided one from the other by one or more walls that are thermally insulated in order to maintain the temperature in the freezer compartment at, for example, about 0° F. and in the fresh food compartment at approximately 37° F. Of course, these are exemplary temperature ranges only.

Gaskets are provided to seal around access openings to these compartments and the gaskets extend from peripheral regions of doors that closes the access opening to the respective compartment. The gaskets sealingly contact a generally planar, perimeter surface of the housing or case that surrounds the access opening when the doors are closed. Thus, the metal or housing surface is exposed to 0° air from the freezer compartment, for example, along one edge of the gasket and exposed to ambient air associated with the room along another edge of the gasket. Since the metal housing is thermally conductive, a portion of this metal (sometimes referred to as a mullion bar), or specifically that housing area between a pair of gaskets, conducts the heat in and conducts the cold out. As a result, a gap region of the housing between the gaskets or adjacent the gaskets is exposed to ambient air and can be at a temperature below the dew point temperature. Fog or moisture can form beads of sweat in this mullion region and the beads can coalesce to form water droplets that potentially reach the floor.

To prevent the formation of moisture or sweat in these regions, a heater such as a low wattage electric resistance heater is typically employed. This heater(s) is sometimes referred to as an anti-sweat or mullion heater. One type of these heaters operates on approximately 8 to 12 watts and is preferably a fine nichrome wire heater wrapped in and insulated by a surrounding vinyl sheathing. The wire is disposed on a cloth carrier that is attached to an adhesive backed foil. These small resistance-type heaters are usually secured to those areas of the refrigerator where sweat is likely to collect, for example along edges of the door, case flange, mullion, etc. In a side-by-side refrigerator, the gaskets of the side-by-side doors form a generally vertically extending channel there between which can contribute to potential water drippage through the channel. Understandably, water dripping on the floor adjacent the refrigerator is undesirable and thus the anti-sweat heaters are used to raise the temperature in these regions above the dew point.

In response to utility companies beginning to charge higher rates during peak demand periods, there is a desire to control or reduce energy use by appliances which also results in a potential cost savings for the consumer/homeowner. Various responses have been proposed for different appliances, including refrigerators, when higher rates are being charged during peak demand periods. Generally speaking, inactivating or disabling anti-sweat heaters is sometimes avoided as a viable demand response option during peak pricing because of the potential concern that moisture or water could reach the floor. It is recognized that peak pricing periods could last two to four hours or more and, in this time frame, there is the possibility that sweat could develop in such regions. Moreover, 8-12 watts is deemed to be a relatively small value and thus proposed demand responses have focused on other energy and cost saving areas that could result in a greater energy savings.

Consequently, a need exists for providing a demand response that addresses the anti-sweat heaters and the potential energy and cost savings associated therewith.

SUMMARY OF THE DISCLOSURE

An appliance, for example a refrigerator, includes a housing having a cooled storage compartment and an anti-sweat heater for warming at least a portion of the housing exposed to the ambient air. A controller is operatively connected to one or more power consuming features or functions of the refrigerator. The controller is configured to operate the appliance in a normal operating mode and/or an energy savings mode, specifically inactivating the anti-sweat heater in the energy savings mode, but activating the anti-sweat heater for at least a limited time period during the energy savings mode to limit sweat and moisture.

The anti-sweat heater is cyclically activated by the controller during the energy savings mode.

The refrigerator may include a moisture detecting sensor operative to detect the presence or absence of moisture proximate the sensor and the controller activates the anti-sweat heater in response to the sensor detecting moisture.

The anti-sweat heater and sensor are incorporated into a mullion in the housing in one preferred arrangement, or located in a region where moisture tends to form.

The controller automatically overrides the inactive status of the anti-sweat heater in the energy savings mode when sweat or fog is present and the anti-sweat heater is activated in response to sensing sweat or fog.

The preferred form of the sensor is an impedance sensing device that changes electrical impedance in response to the presence of moisture or fog.

The anti-sweat heater can be turned off once moisture or fog is removed, or alternatively operated for a pre-specified time after the absence of moisture is detected to prevent short cycling of the anti-sweat heater by the controller.

A control method for the appliance or refrigerator receives a demand response signal that is indicative of at least a peak demand period and an off-peak demand period. During the off-peak demand period, the method includes operating the refrigerator in a normal mode. During the peak demand period, the method includes operating the refrigerator in an energy saving mode. The energy saving mode includes disabling an anti-sweat heater, providing a sensor on an external surface of the refrigerator, and enabling the anti-sweat heater during the peak demand period if moisture is detected by the sensor.

The enabling step includes automatically overriding the demand response signal (inactivating the anti-sweat heater) and activating the anti-sweat heater in response to moisture.

The enabling step includes creating a location on the housing where moisture will initially form and locating a sensor on the housing at the created location, one embodiment of which includes forming a depression on the refrigerator and locating the sensor at the depression where the moisture collects.

The enabling step includes providing reduced thermal insulation in the housing at the created location to encourage moisture formation at the created location prior to forming on adjacent surfaces.

In a preferred arrangement, the enabling step includes detecting the electrical impedance of a sensor located on the housing.

A primary advantage is the ability to provide a low cost solution to taking advantage of load shedding in a peak demand period.

Yet another advantage resides in a low cost solution that can be attained without the concern of sweat or moisture.

Still another advantage is the lack of any moving parts or components that would otherwise lead to failure.

Still another advantage is the ease with which the refrigerator can automatically and easily override a demand response signal to inactivate the anti-sweat heaters, and reactivate the anti-sweat heaters when fog or running beads of sweat are detected.

Still other benefits and advantages of the present disclosure will become apparent from reading and understanding the following detailed description,

DETAILED DESCRIPTION OF THE PREFERRED EMBODIMENTS

Figure 2:
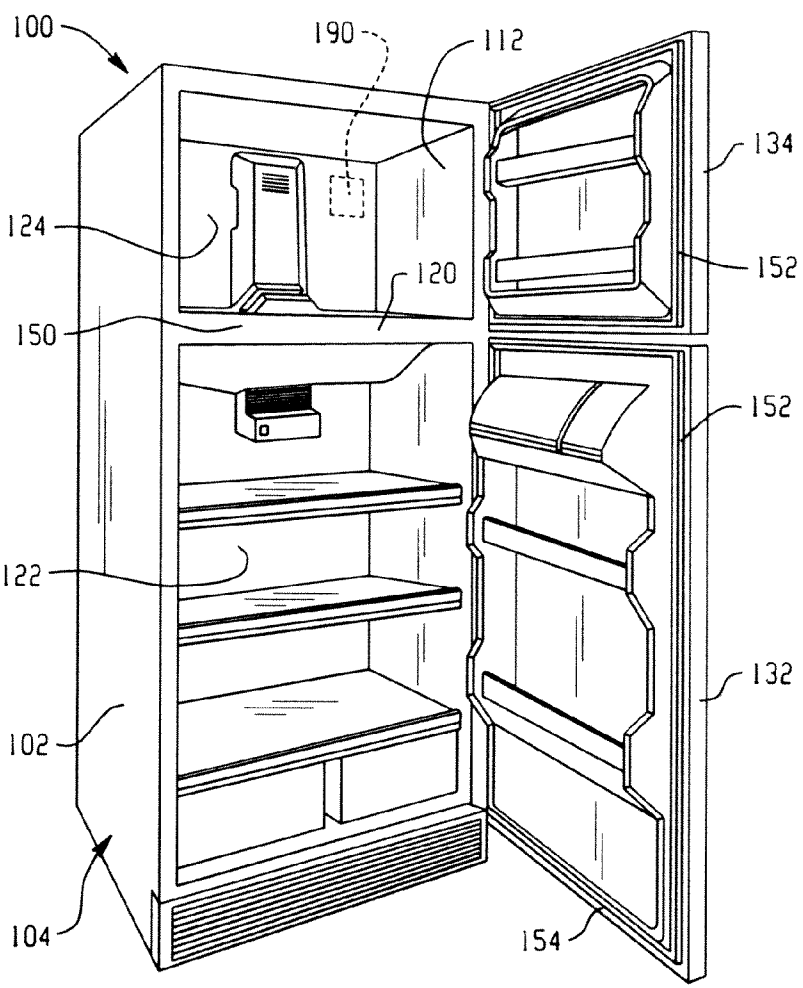
FIGS. 1-4 illustrate various types of refrigerators with which the present disclosure can be used.
Figure 1:
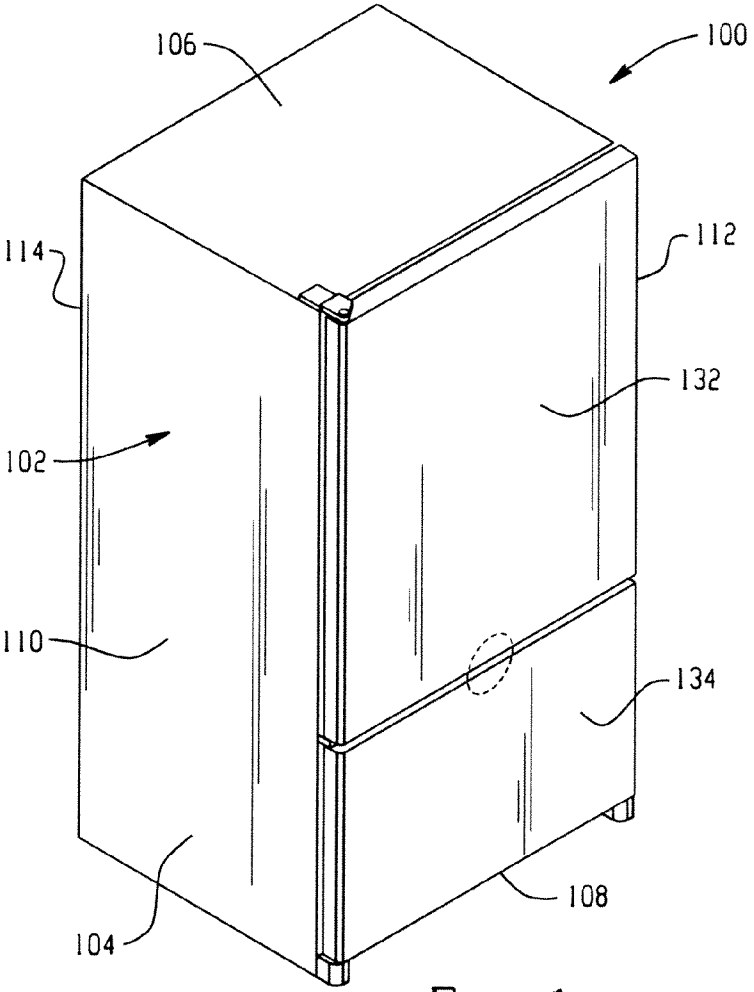

FIGS. 1-4 illustrate various models of refrigerators 100, and although the various models may have different features, for purposes of the present disclosure, many of these detailed features are not pertinent. Thus, these various types of refrigerators are all common with respect to including at least one cooled storage compartment, and preferably first and second cooled storage compartments generally referred to as a fresh food storage compartment and a freezer compartment. Therefore, like reference numerals will be used to identify like components throughout these FIGURES for ease of identification.

Figure 4:
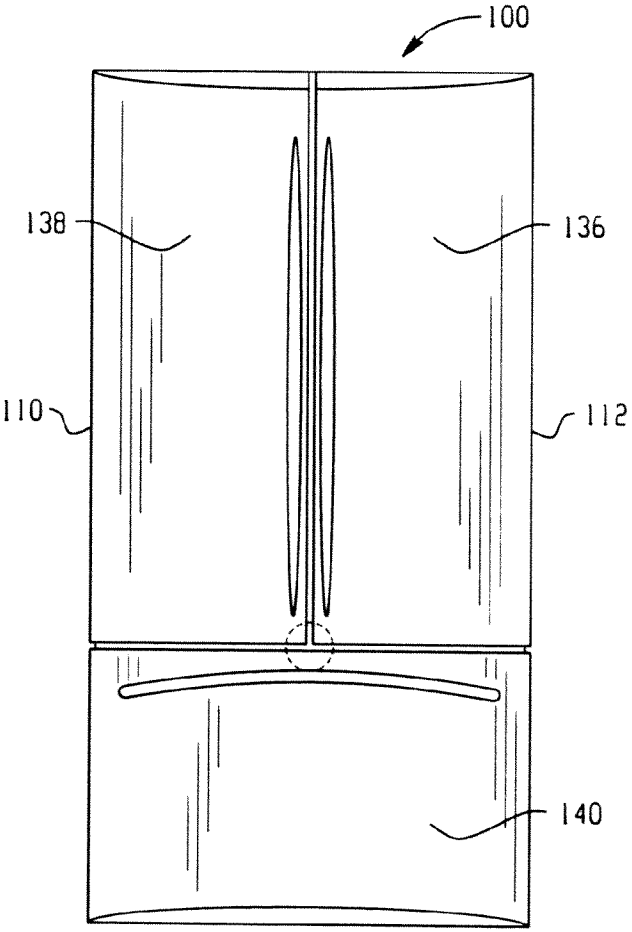
Figure 3:
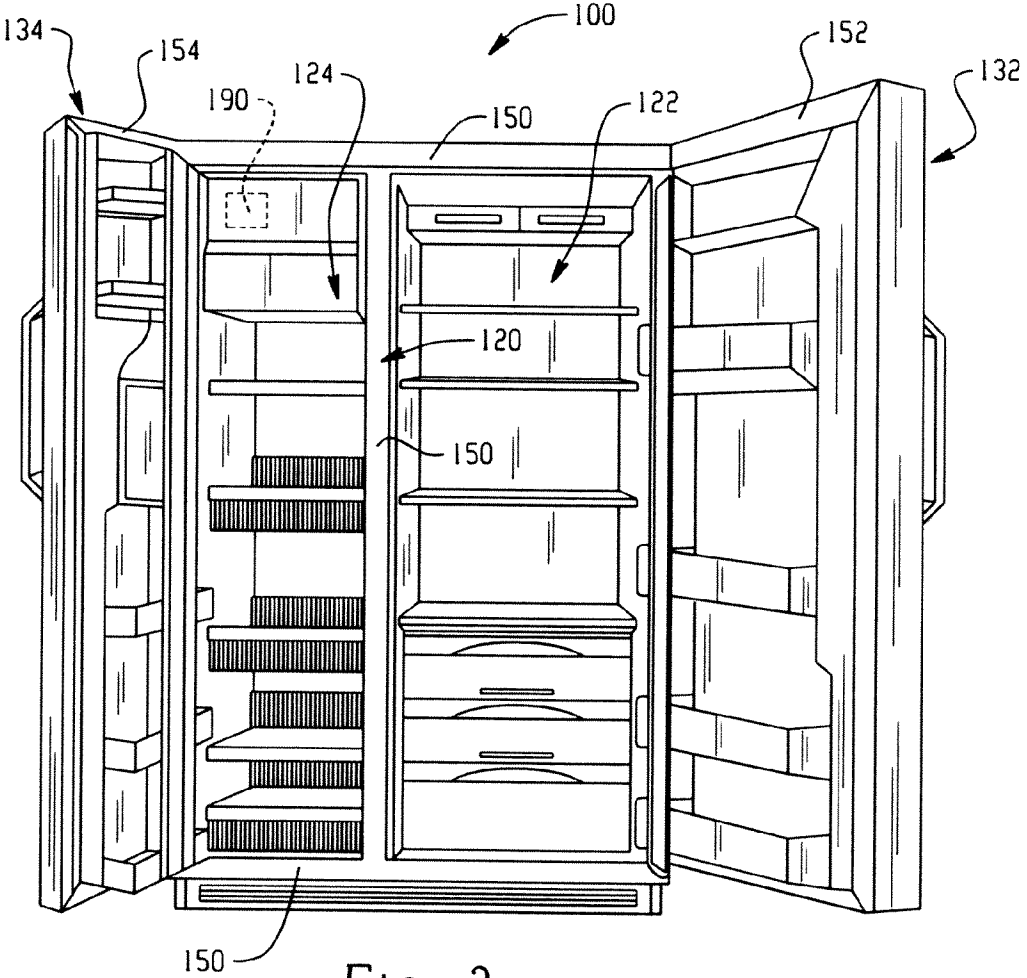

More particularly, the refrigerator 100 has a cabinet 102 that includes an outer case, shell, or housing 104 having a top wall 106, bottom wall 108, sidewalls 110, 112, and a rear or back wall 114. Typically, the housing is formed of a thin metal material and the walls are thermally insulated. A dividing wall 120 separates the refrigerator into a fresh food storage compartment 122 and a freezer compartment 124. These compartments can be in a bottom mount arrangement where the freezer is on the bottom and the fresh food is on the top, or a top mount where the freezer is on top and the fresh food compartment is on the bottom (FIGS. 1 and 2), or a side-by-side model as shown in FIG. 3, or more recent vintage model of a fresh food compartment on top as shown in FIG. 4. Whereas the embodiments of FIGS. 1-3 each include a fresh food storage compartment door 132 and a freezer compartment door 134, the particular model of FIG. 4 includes a pair of fresh food storage compartment doors 136, 138 that are hinged adjacent the sidewalls 110, 112 and the freezer compartment is not a hinged door but a slidable drawer 140. As is well understood in the art, the fresh food storage compartment and the freezer compartment are separated by the dividing wall and closed off from the ambient environment via the drawer or doors.

A sealing member or gasket is provided about a perimeter of the door or drawer and engages a planar surface, typically a metal surface 150 of the housing 104 engaged by the gaskets 152, 154 that are mounted on the respective doors or drawer. The housing surfaces 150 selectively engaged by the gaskets are exposed to the cooler temperatures of the fresh food storage compartment and the freezer compartment along one edge or region and to ambient air along an adjacent edge or region. When the cooled, refrigerated air impinges on any exposed metal within the refrigerated space, conducts through the cross-section of the gasket, or leaks past the gasket or seal area, the thermally conductive metal surface tends to fall below the dew point of the surrounding atmosphere. These regions, therefore, are prone to potential accumulation of fog, moisture, or water droplets. Therefore, the representative encircled regions in FIGS. 1-4 are areas where condensation may accumulate and could lead to water dripping on the floor below the refrigerator. To overcome this problem, anti-sweat heaters are employed, and can be of the type described in the Background which heaters are well known in the art. These heaters are typically received in the mullion regions, i.e., incorporated along the edges of the door, case flange, mullions, etc. that are most common and where the gasket typically bears against the housing. For example, commonly-owned U.S. Pat. Nos. 4,332,142 and 4,822,117 show and describe such anti-sweat or mullion heaters that are employed in prior refrigerators to address the moisture issue. The mullion bars typically have insulation generally uniformly provided along an interior surface, i.e., behind them, in order to limit the thermal conduction from the cooler fresh food and freezer compartments.

Figure 5:
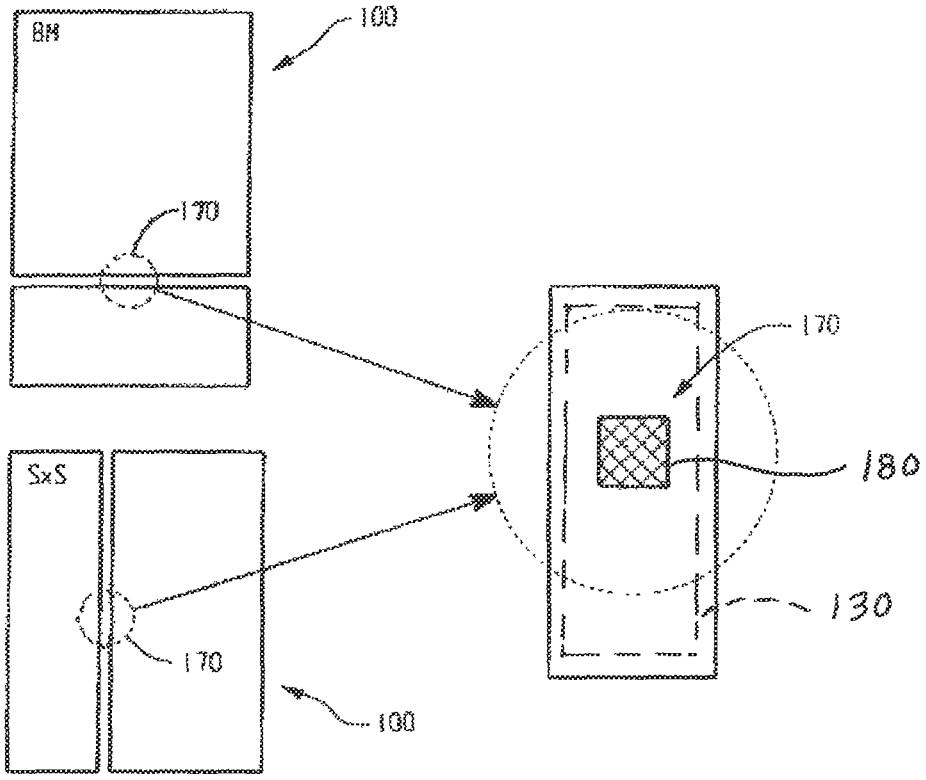
FIG. 5 is an enlarged representation of the encircled areas.

As shown in FIG. 5, a preselected location 170 on the housing is created. In a preferred arrangement, the preselected location 170 is a depressed section, i.e., a region where the fog or sweat may coalesce, and behind the mullion is preferably a region with less insulation relative to adjacent regions of the insulated mullion. As a result, this preselected location or created area will tend to be cooler than adjacent regions of the mullion bar because of the reduced insulation. Moreover, the depression acts as a collector for the fog or moisture that may develop in this location so that any moisture that does develop can be reliably considered as the incipient formation of moisture or a bead of water.

Figure 6:
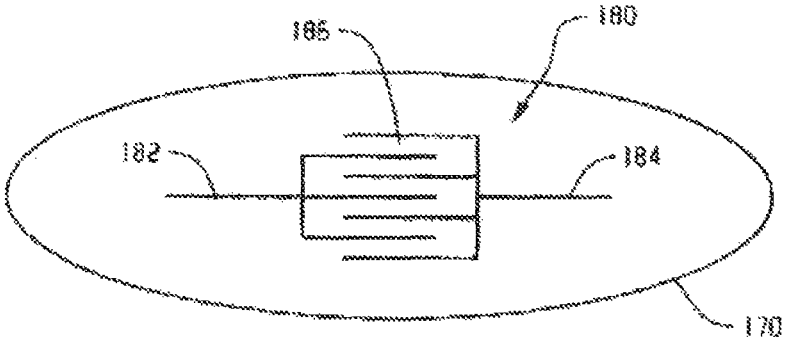
FIG. 6 is a still further enlarged representation of one preferred form of sensor used in FIG. 5.
Figure 7:
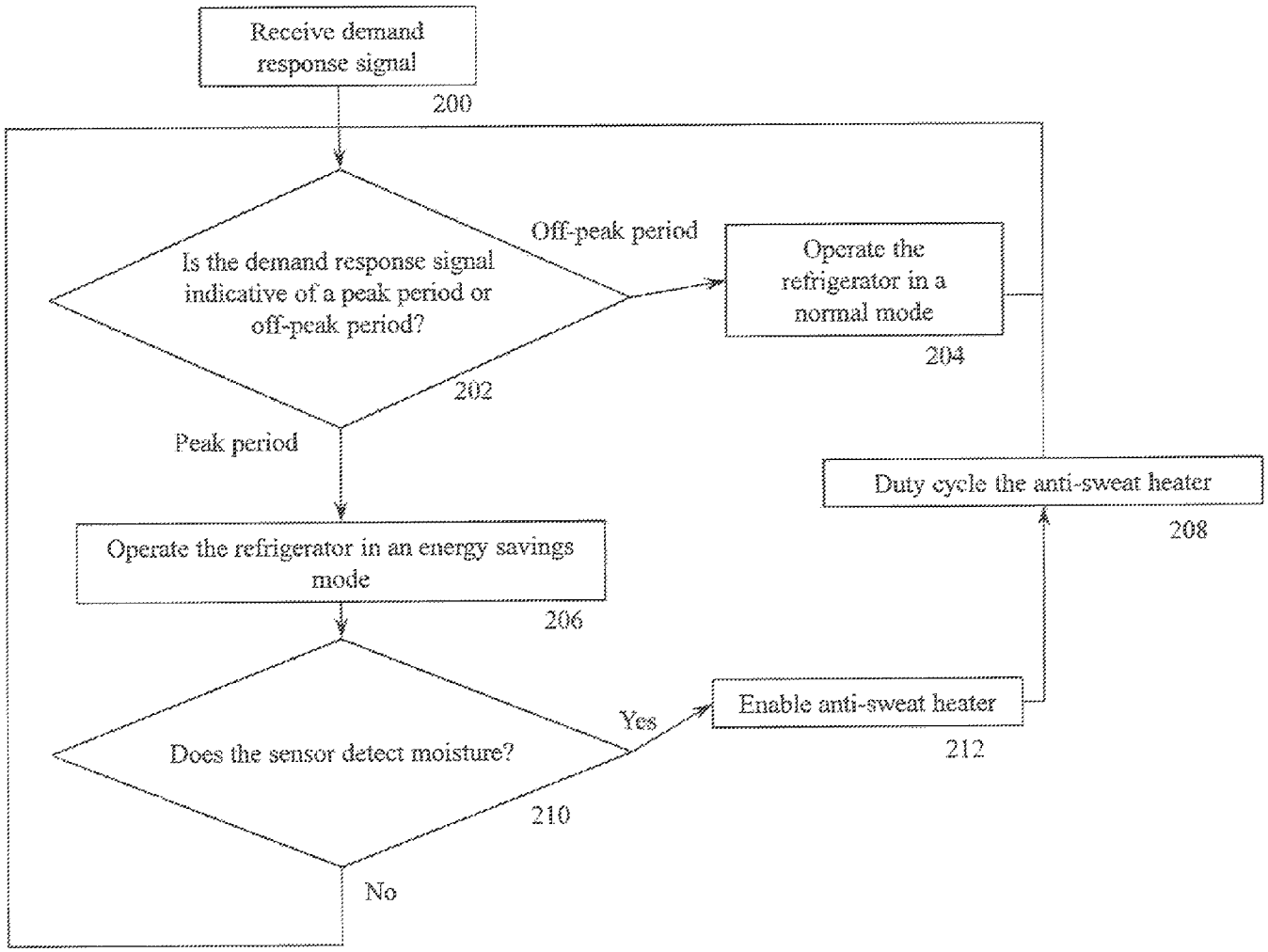
FIG. 7 is a chart illustrating a control method for an appliance or refrigerator.

With continued reference to FIG. 5 and additional reference to FIG. 6, the preselected location 170 includes a sensor 180. A preferred form of sensor 180 is an impedance grid sensor formed by first and second contacts 182, 184 that have interleaved portions 186 disposed in spaced locations and that is attached to the depressed, preselected location 170. The impedance between the sensor contacts 182, 184 in the interleaved portions 186 is monitored. Typically the impedance will be very high as a result of the physical spacing between the contacts. However, as fog develops, the impedance is reduced permitting current to begin to flow between the contacts. At a selected threshold impedance level (that correlates to a level of acceptable/unacceptable moisture), the sensor impedance level that is communicated to a controller 190 of the refrigerator activates the anti-sweat heaters which were previously disabled during a peak pricing period. The anti-seat heaters are activated as a result of the reduced impedance level detection. Even if the demand signal or utility indicates that reduced energy use is desired, the sensor provides a signal of incipient moisture formation and the controller 190 automatically overrides the energy savings response (i.e., inactivating the anti-sweat heaters in this scenario in order to activate the heaters and prevent moisture from dripping on the floor.

It will be appreciated that the preselected location 170 can be any external surface of the appliance, and particularly one that is typically protected with an anti-sweat heater 130. Creating the imperfection (reduced insulation) provides greater control over an accurate location of the impedance sensor at the location of the imperfection. Depressing the region will also facilitate collection of the moisture at this location and allows the impedance sensor 180 to be accurately monitored to provide for immediate override of the previously disable anti-sweat heaters through the demand response. In this manner, the anti-sweat heaters are activated.

A control method for the appliance or refrigerator receives a demand response signal 200 that is indicative of at least a peak demand period and an off-peak demand period 202. During the off-peak demand period, the method includes operating the refrigerator in a normal mode 204. During the peak demand period, the method includes operating the refrigerator in an energy saving mode 206. The energy saving mode includes disabling an anti-sweat heater, providing a sensor on an external surface of the refrigerator, and enabling the anti-sweat heater during the peak demand period 212 if moisture is detected by the sensor 210.

Once the anti-sweat heaters are turned on in the energy savings mode as a result of detecting moisture or fog, the sensor can continue to monitor the impedance and can shut off the heaters when the moisture is evaporated away or after a predetermined time, to provide for reduced energy use and associated cost savings. Thus, limits can be set to allow the anti-sweat heaters to duty cycle on and off 208 between two impedance levels, such as between 1 M ohm and 20 K ohm. Alternatively, the anti-sweat heater can be turned on when the impedance is significantly reduced by the collection of moisture and the anti-sweat heater left on for a predetermined time period or for the remainder of the energy savings mode in order to prevent short-cycling of the anti-sweat heater (i.e., short cycling is frequent on/off cycling that can occur when the moisture is driven off and then accumulates again in a short timeframe so to avoid short cycling, then the anti-sweat heater can be left on for an extended period of time beyond the minimum impedance setpoint to further raise the temperature of the mullion region and keep sweat from developing too quickly).

It will be appreciated that sensing the moisture or sweat early in the process can be helpful in preventing formation of beads of water. Thus, positioning the sensor in an area where the anti-sweat heater is located and where those skilled in the art expect sweat to form in the absence of the heater being on would be advantageous.

The structure and operation of mullion heaters are generally well known and such an anti-sweat heater is deemed to be one of the most cost effective manners of preventing the collection of condensation on the housing. As a result, one demand supply response to a peak pricing period can now be to turn off the mullion heaters since the inactivated anti-sweat heaters can be turned on once the sweat or moisture is detected. It is also contemplated that if the energy savings period is still active, another response is to reduce the voltage or alter the operation of the anti-sweat heaters, e.g., the voltage can be pulsed or proportionally controlled, etc.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. A refrigerator comprising:

a housing enclosing a cooled storage compartment, the housing comprising a mullion;

at least one sensor configured to detect moisture on a region of the housing, the region being one or more areas of the housing where moisture tends to form including the mullion, the region having less insulation relative to adjacent regions of the housing;

at least one anti-sweat heater located in said region and configured to heat said region, the at least one anti-sweat heater comprising an active mode and an inactive mode;

a controller operatively connected to one or more power consuming features/functions of the refrigerator, the controller configured to communicate with the at least one sensor to monitor moisture in said region, and receive and process a demand response signal from a utility and in response thereto operate the refrigerator in one of a plurality of operating modes including at least a normal operating mode and an energy savings mode when the demand response signal evokes an energy savings response, wherein the at least one anti-sweat heater is set to the active mode when the refrigerator is in the normal operating mode, and to the inactive mode when the refrigerator is in the energy savings mode, and wherein if the at least one sensor detects a level of moisture exceeding a predetermined acceptable level when the anti-sweat heater is inactive in the energy savings mode, the controller is configured to override the energy savings response and automatically set the anti-sweat heater to the active mode for at least a predetermined time to remove moisture.

2. The refrigerator of claim 1 wherein the controller cyclically activates the anti-sweat heater during the energy savings mode.

3. The refrigerator of claim 1 wherein the controller activates the anti-sweat heater to duty cycle to maintain a first moisture level during the energy savings mode that is higher than a second moisture level which is maintained for the anti-sweat heater in the normal operation mode.

4. The refrigerator of claim 1 wherein the at least one sensor is an impedance sensor configured to detect an impedance level correlating to a level of moisture proximate the sensor and communicate the impedance level to the controller.

5. The refrigerator of claim 4 wherein, in the energy savings mode, the controller is further configured to duty cycle the anti-sweat heater when the detected impedance level communicated to the controller is between two predetermined impedance levels limits.

6. The refrigerator of claim 1 wherein the region is a depression in the housing.

7. An appliance comprising:

a housing enclosing a cooled storage compartment, the housing comprising a mullion;

at least one sensor configured to detect moisture on a region of the housing, the region being one or more areas of the housing where moisture tends to form including the mullion, the region having less insulation relative to adjacent regions of the housing;

at least one electrical anti-sweat heater located in said region and configured to heat said region, the at least one electrical anti-sweat heater comprising an active mode and an inactive mode;

a controller operatively connected to one or more power consuming features/functions of the appliance, the controller configured to communicate with the at least one sensor to monitor moisture in said region, and receive and process a demand response signal from a utility and in response thereto operate the appliance in one of a plurality of operating modes including at least a normal operating mode and an energy savings mode when the demand response signal evokes an energy savings response, wherein the at least one anti-sweat heater is set to the active mode when the refrigerator is in the normal operating mode, and to the inactive mode when the refrigerator is in the energy savings mode, and wherein if the at least one sensor detects a level of moisture exceeding a predetermined acceptable level when the anti-sweat heater is inactive in the energy savings mode, the controller is configured to override the energy savings response and automatically set the anti-sweat heater to the active mode for at least a predetermined time to remove moisture.

8. The refrigerator of claim 7 wherein the at least one sensor is an impedance sensor configured to detect an impedance level correlating to a level of moisture proximate the sensor and communicate the impedance level to the controller.

9. The refrigerator of claim 8 wherein, in the energy savings mode, the controller is further configured to duty cycle the anti-sweat heater when the detected impedance level communicated to the controller is between two predetermined impedance levels limits.

10. The refrigerator of claim 8 wherein the controller activates the anti-sweat heater to duty cycle to maintain a first moisture level during the energy savings mode that is higher than a second moisture level which is maintained for the anti-sweat heater in the normal operation mode.

11. The refrigerator of claim 7 wherein the region is a depression in the housing.

* * * * *

UNITED STATES PATENT AND TRADEMARK OFFICE

CERTIFICATE OF CORRECTION

PATENT NO. : 9,291,383 B2
APPLICATION NO. : 12/859411
DATED : March 22, 2016
INVENTOR(S) : John K. Besore It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1227 days.

Signed and Sealed this
Twenty-eighth Day of June, 2016

Michelle K. Lee

Michelle K. Lee
*Director of the United States Patent and Trademark Office*